US007004368B1

(12) United States Patent
Chen

(10) Patent No.: US 7,004,368 B1
(45) Date of Patent: Feb. 28, 2006

(54) NAILING GUN HAVING IMPROVED NAIL PUSHER

(75) Inventor: Robert Chen, Tai-Ping (TW)

(73) Assignee: Panrex Industrial Co., Ltd., Tai-Ping (TW)

( * ) Notice: Subject to any disclaimer, the term of this patent is extended or adjusted under 35 U.S.C. 154(b) by 0 days.

(21) Appl. No.: 11/003,277

(22) Filed: Dec. 3, 2004

(51) Int. Cl.
*B25C 5/02* (2006.01)

(52) U.S. Cl. ..... 227/120; 227/109; 227/127; 227/132

(58) Field of Classification Search ..... 227/120, 227/125, 127, 128, 132, 109
See application file for complete search history.

(56) References Cited

U.S. PATENT DOCUMENTS 5,297,713 A * 3/1994 Perra et al. ..... 227/123
5,522,533 A * 6/1996 Mukoyama et al. ..... 227/109
5,642,849 A * 7/1997 Chen ..... 227/123
6,641,019 B1 * 11/2003 Hadfield ..... 227/109
6,644,530 B1 * 11/2003 Chen ..... 227/109
6,679,413 B1 * 1/2004 Miller et al. ..... 227/120
2005/0001001 A1 * 1/2005 Nakano et al. ..... 227/8
2005/0121488 A1 * 6/2005 Sun ..... 227/109
2005/0121490 A1 * 6/2005 Sun ..... 227/120

* cited by examiner

*Primary Examiner*—Scott A. Smith
*Assistant Examiner*—Brian Nash
(74) *Attorney, Agent, or Firm*—Knobbe Martens Olson & Bear LLP

(57) ABSTRACT

A nail magazine includes a magazine base and a magazine cover which are coupled slidably to each other to confine a nail channel. The magazine base has a guide groove which is communicated with the nail channel and receives a guide tube which in turn receives a coiled spring. A nail pusher plate is slidably received in the nail channel and attached to the magazine cover. A protrusion of the nail pusher plate extends slidably into the guide tube and connected to the coiled spring so that the nail pusher plate is urged by the coiled spring.

3 Claims, 12 Drawing Sheets

NAILING GUN HAVING IMPROVED NAIL PUSHER

BACKGROUND OF THE INVENTION

1. Field of the Invention

This invention relates to a nailing gun, more particularly to a nailing gun incorporating an improvement relating to a nail pusher.

2. Description of the Related Art

Referring to FIGS. 1 to 3, a nail driving gun generally includes a nail shooting nose 100 connected to a barrel 200 and a nail magazine 300. The nail shooting nose 100 includes a base plate 101 and a face plate 102. First and second safety plates 401, 402 are disposed between the base and face plates 101 and 102. The nail magazine 300 has a nail pusher plate 301 which serves to push a nail stick (not shown) placed within the nail magazine 300 toward the base plate 101. The base plate 101 has a nail outlet 106 to receive a nail fed to the base plate 101.

The first and second safety plates 401, 402 are secured to each other. A safety member 403 has one end 404 extending in to a hole 406 formed in the first safety plate 401 through a hole 108 of the base plate 101, and another end 405 connected to an actuating plate 407 which in turn is connected to a valve rod 408 that controls a pneumatically operated nail driving mechanism mounted within the barrel 200. A trigger 409 is provided to activate the actuating plate 407.

When no nail shooting operation is performed, the end 405 of the safety member 403 is biased by a spring (not shown) so that the first and second safety plates 401, 402 are pushed by the end 404 of the safety member 403 to protrude outwardly of the base plate 101 and the face plate 102. When a nail shooting operation is performed, the nail shooting nose 100 is pressed against a site to be nailed. As a result, the first and second safety plates 401 and 402 are pushed upward so that the safety member 403 depresses the actuating plate 407. In this situation, the pressing of the trigger 409 will activate the actuating plate 407 and the valve rod 408 so that a nail is driven outward from the nail shooting nose 100.

When the nails in the nail magazine 300 are used up, the nail pusher plate 301 moves to the base plate 101 with a front end 302 thereof protruding into a slot 400 of the first safety plate 401 through an aperture 107 of the base plate 101 so that the first and second safety plates 401, 402 cannot move upward even when the nail shooting nose 100 is pressed against a site to be nailed. As such, the driving mechanism of the nailing gun is prevented from performing idly a nail shooting operation.

Typically, a nail pusher for pushing a nail stick toward a nail shooting nose is loaded with one or more springs which are mounted within a nail magazine. Referring to FIGS. 4 and 5, a conventional nail magazine 11 includes a magazine base 112 and a magazine cover 113 which is coupled with the magazine base 112 by sliding over and interlocking with the magazine base 112. A nail pusher 12 is movably mounted on the magazine cover 113, and springs 13 are connected to the nail pusher 12 and the magazine cover 113. The nail pusher 12 and the springs 13 are received slidably in a nail channel 111 defined by the magazine base 112 and the magazine cover 113. When a nail stick 2 is placed in the nail channel 111, the springs 13 are placed in a compressed state so that the nail stick 2 is urged by the springs 13 to move toward a base plate 114 of a nail shooting nose.

However, since the springs 13 are exposed to the nail channel 11 without any accompanying limiting element, the springs 13 are prone to wobble and deformation. In addition, dusts and debris can intrude into the clearances in the springs 13 due to frequent opening of the nail magazine 11, thus adversely affecting the sliding movement of the nail pusher plate 12. Therefore, protection of the springs from contaminating substances is desirable in order to maintain good performance of the springs 13 and the nail pusher 12.

SUMMARY OF THE INVENTION

An object of the present invention is to provide a nailing gun with an improved nail magazine which incorporates protection means for protecting a spring of a nail pusher.

According to this invention, a nailing gun comprises: a nail magazine including a magazine base and a magazine cover which are coupled slidably to each other to confine a nail channel, the magazine base having a guide groove which is communicated with the nail channel; a spring unit including a guide tube received movably in the guide groove, and a coiled spring received movably in the guide tube; a nail pusher plate slidably received in the nail channel and attached to the magazine cover, the nail pusher plate having a protrusion extending slidably into the guide tube and connected to the coiled spring so that the nail pusher plate is urged by the coiled spring.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
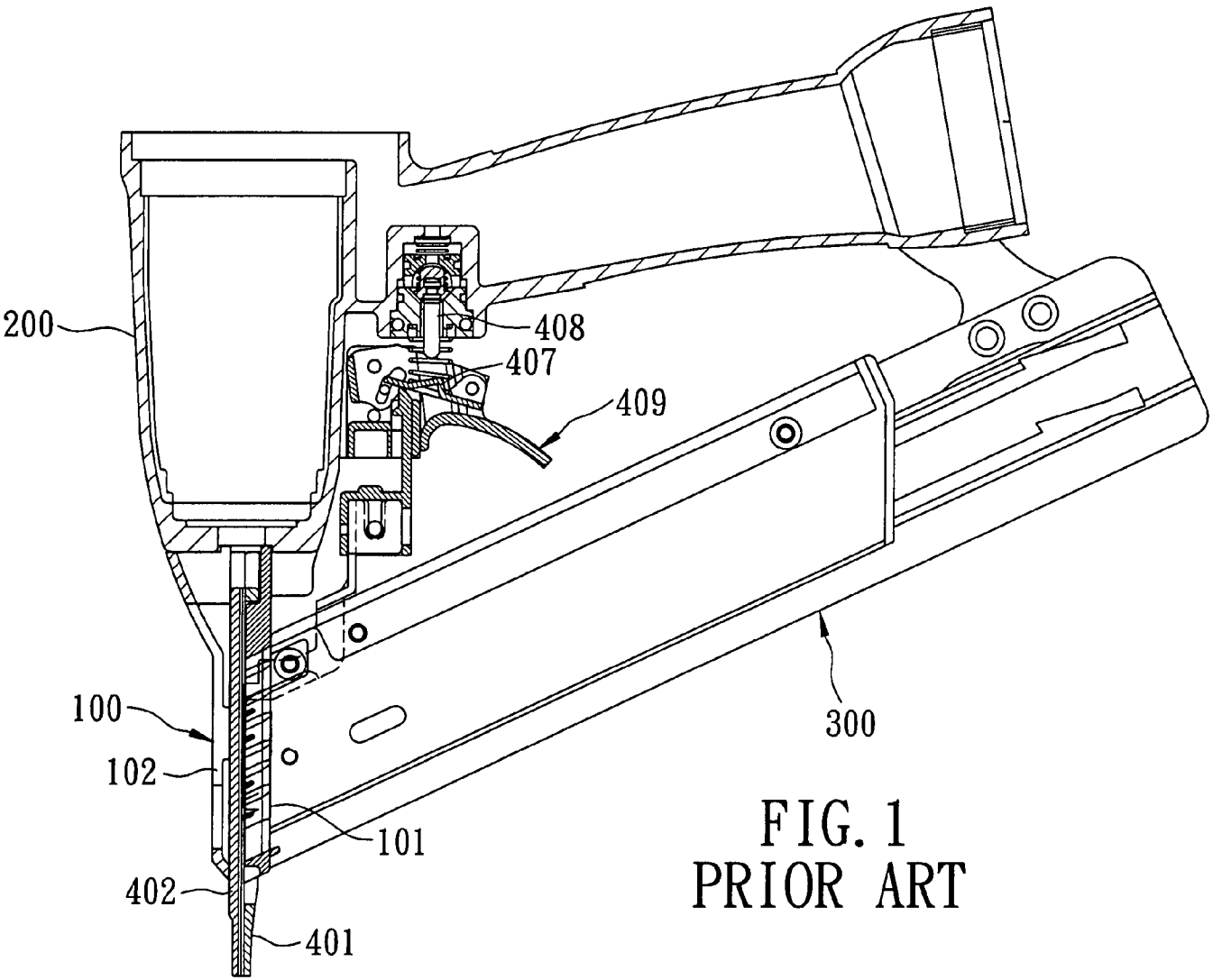
FIG. 1 PRIOR ART
FIG. 1 shows a conventional nailing gun.
Figure 2:
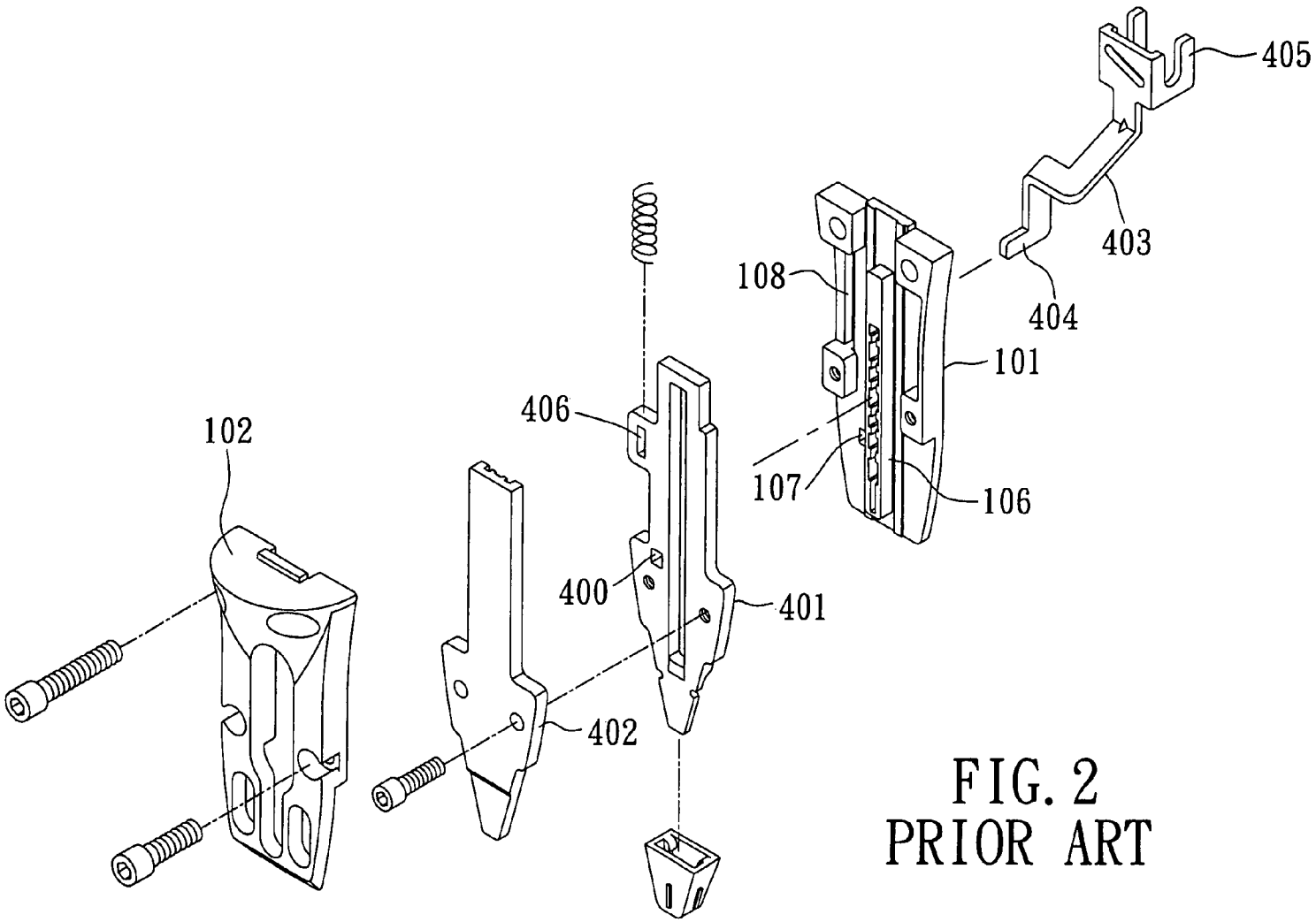
FIG. 2 PRIOR ART
FIG. 2 is an exploded view of a nail shooting nose of the nailing gun of FIG. 1.
Figure 3:
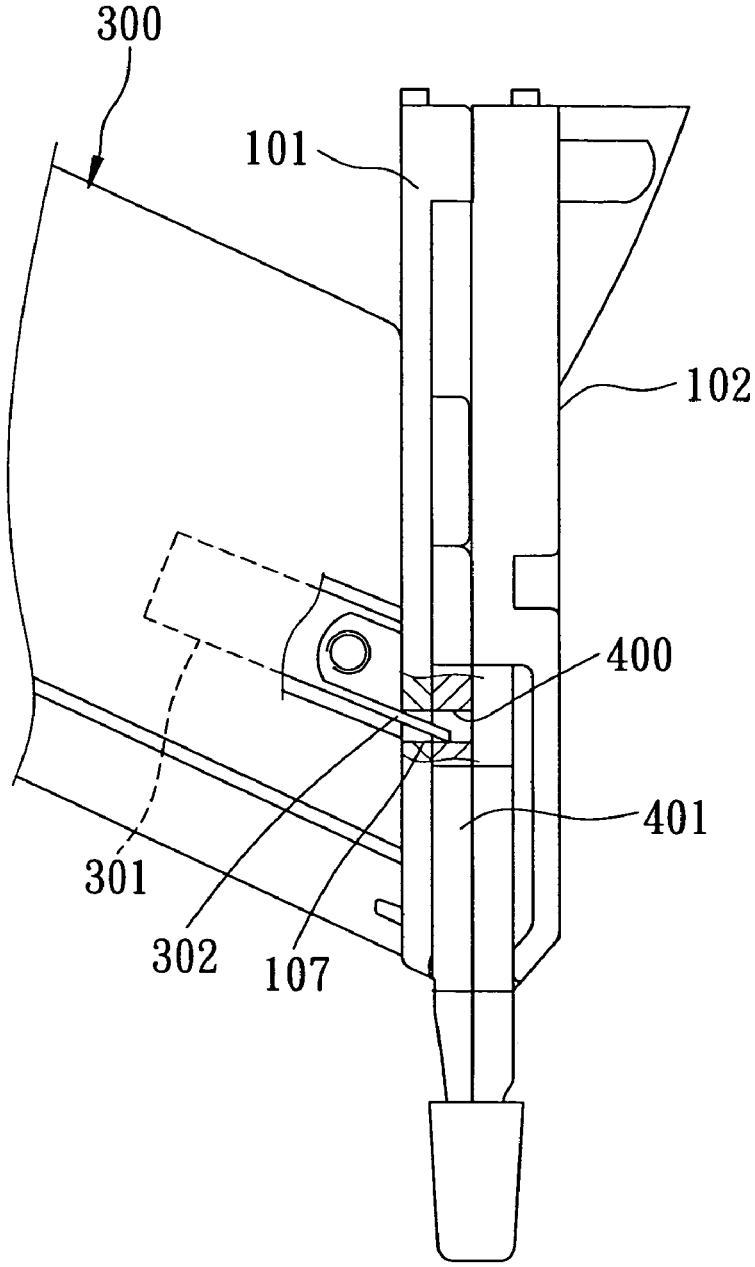
FIG. 3 PRIOR ART
FIG. 3 is a fragmentary view of the nailing gun of FIG. 1.
Figure 4:
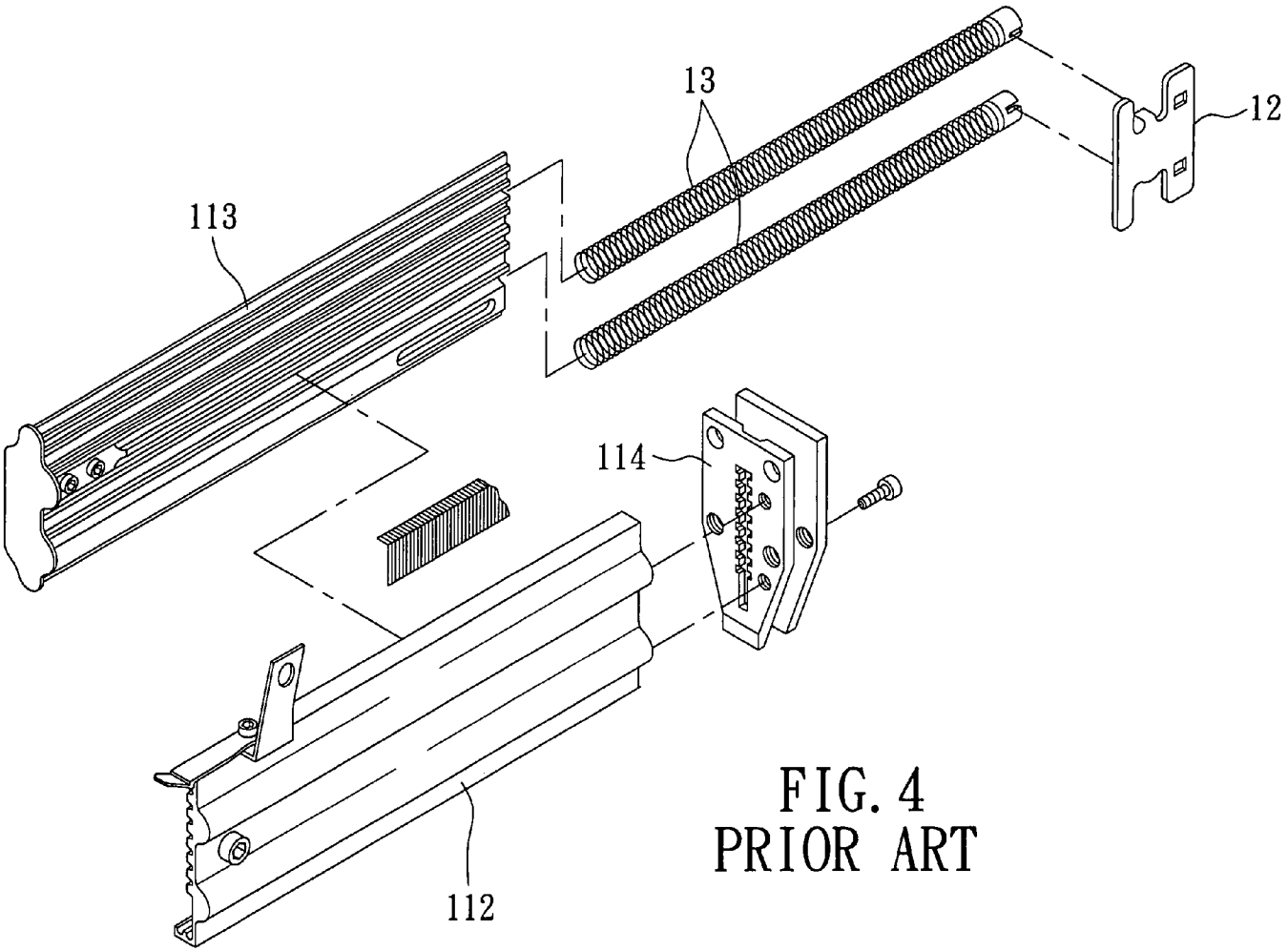
FIG. 4 PRIOR ART
FIG. 4 is an exploded view of a conventional nail magazine.
Figure 5:
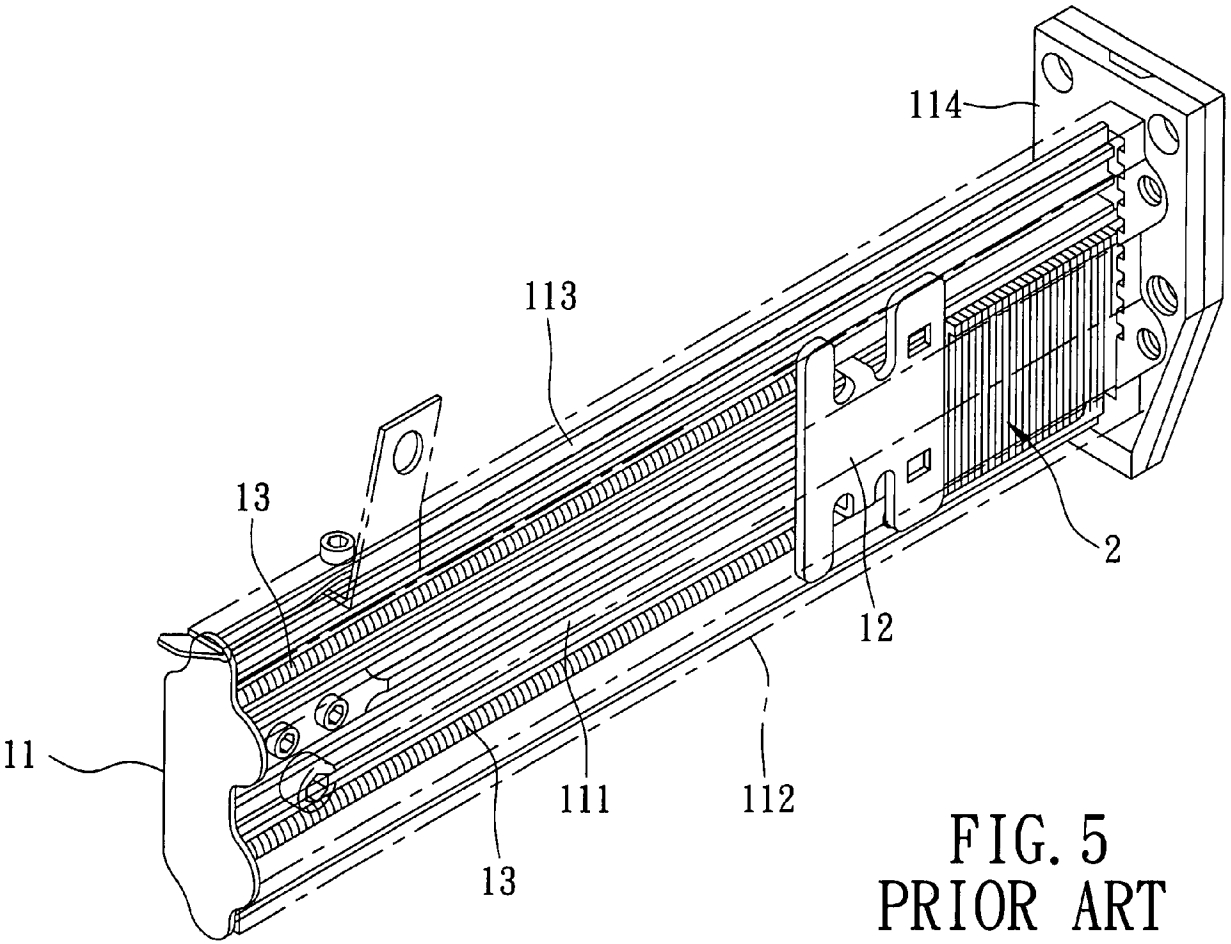
FIG. 5 PRIOR ART
FIG. 5 is a perspective view of the nail magazine of FIG. 4 in an assembled state.
Figure 6:
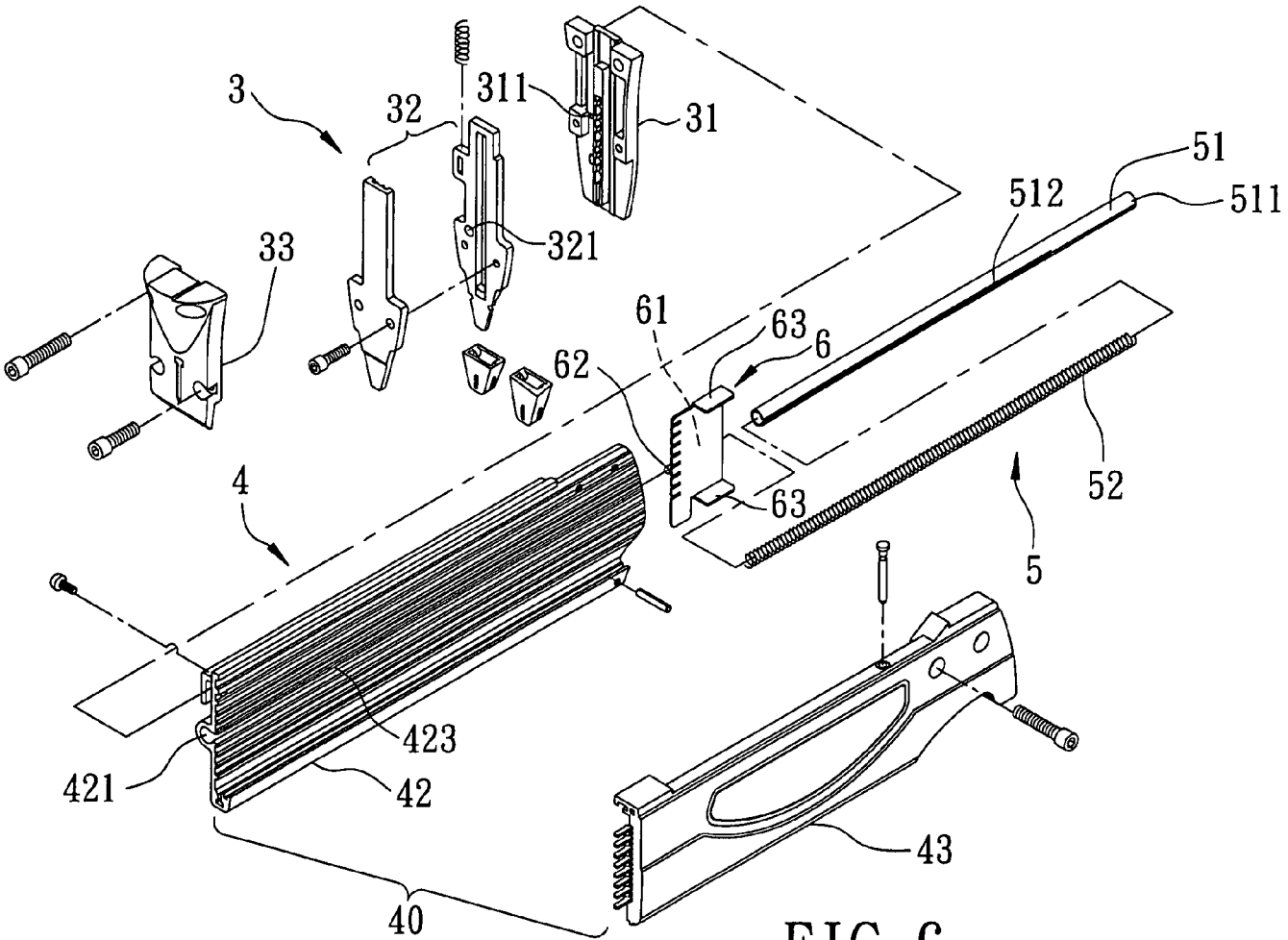
FIG. 6 is an exploded view showing a nail magazine embodying the present invention.
Figure 7:
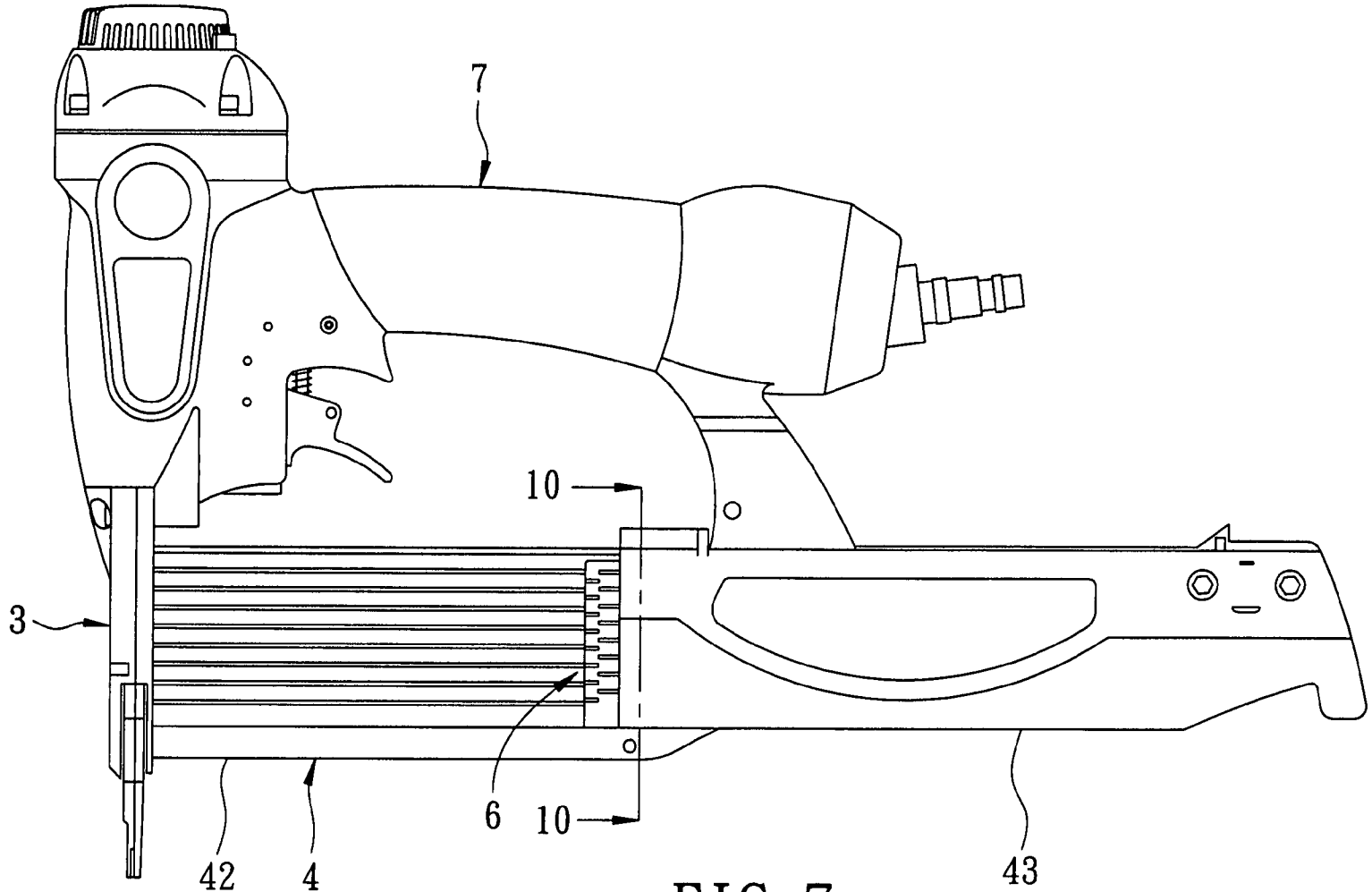
FIG. 7 is a left side view of a nailing gun incorporating the present invention.
Figure 11:
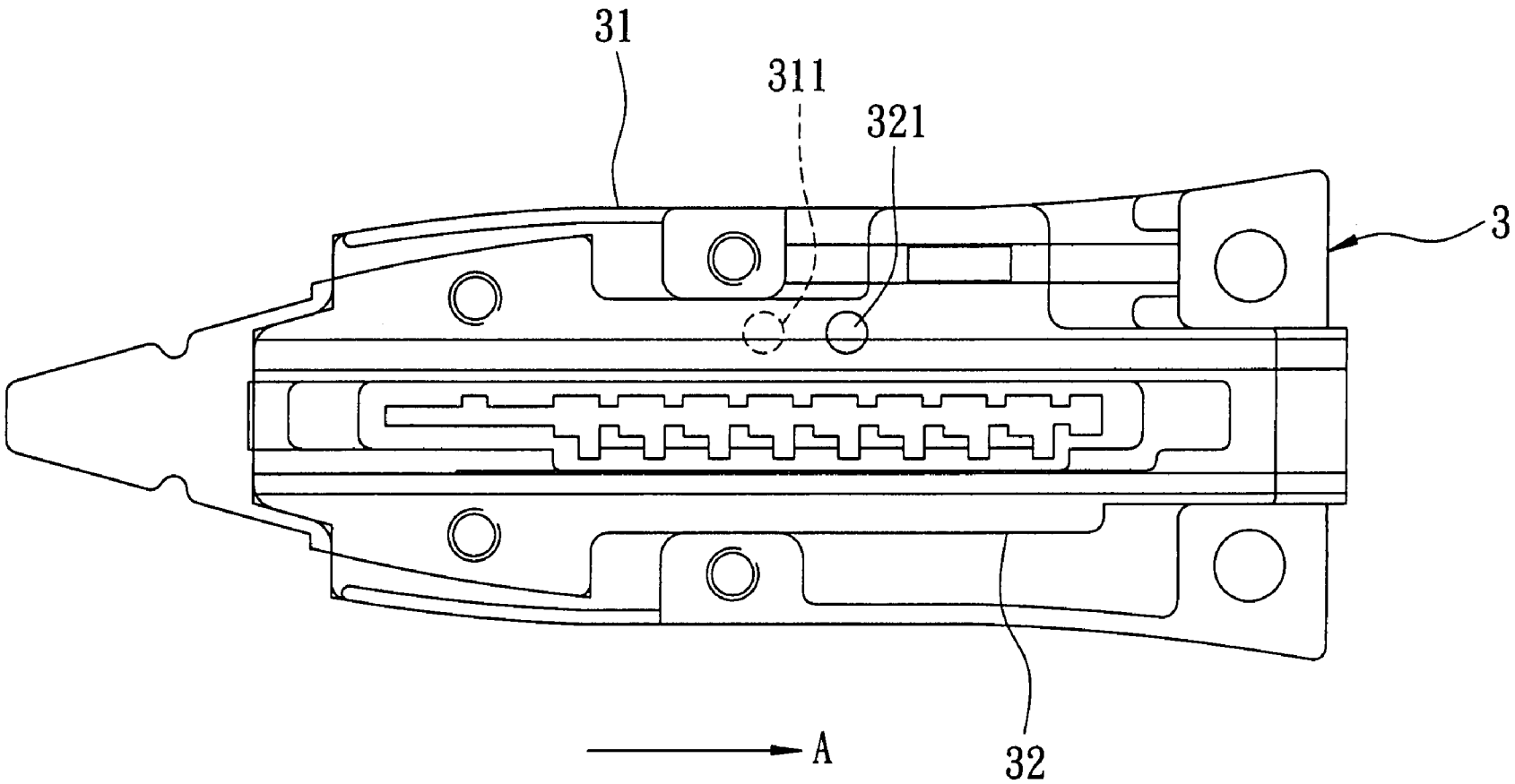
FIG. 11 is a plan view showing a base plate, a face plate and a safety plate assembly shown in FIG. 6.
Figure 12:
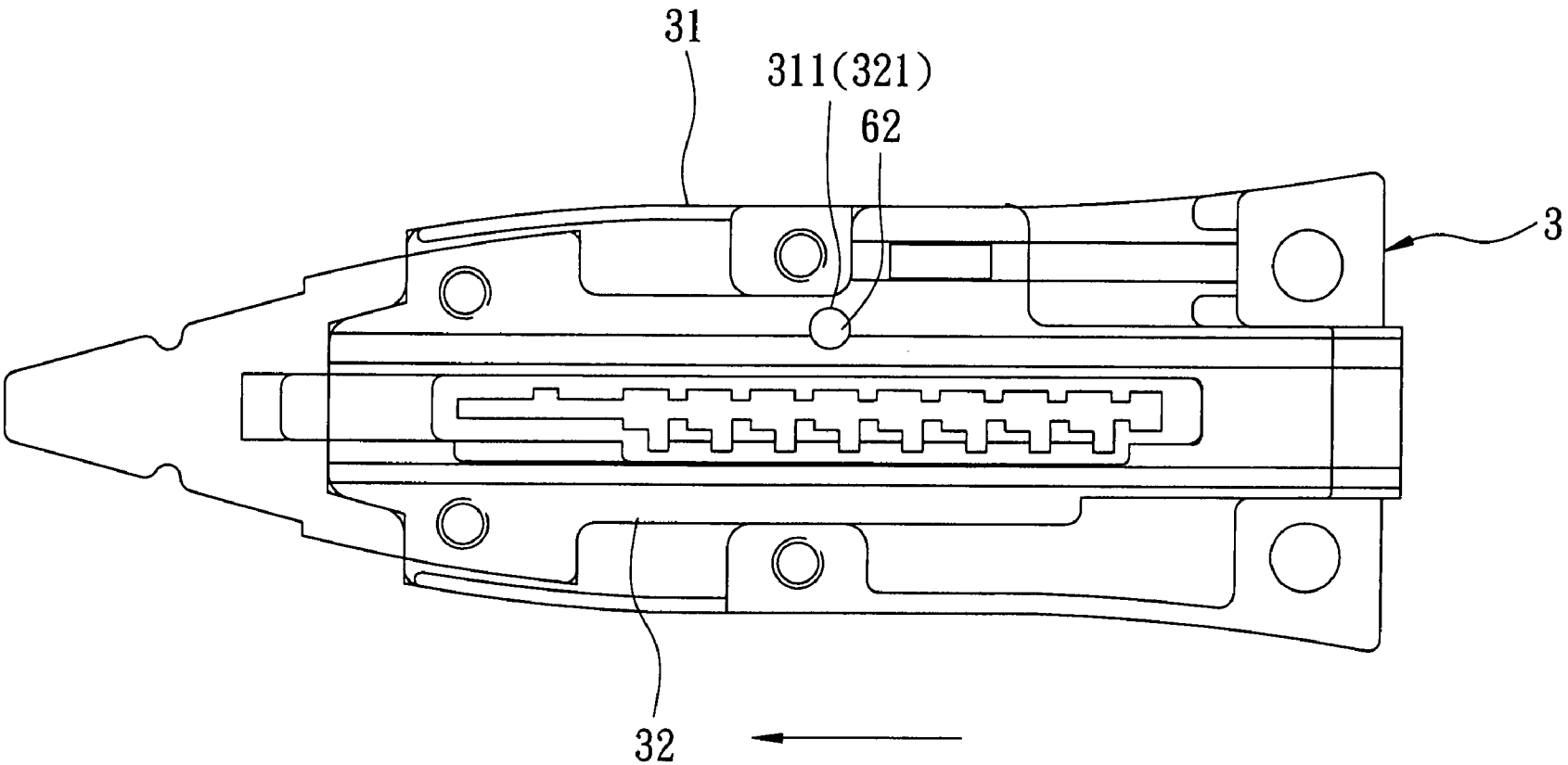
FIG. 12 is the same view as FIG. 11 but with the safety plate assembly moving in a different direction.

Referring to FIGS. 6 and 7, a nailing gun incorporating the present invention includes a main body 7, a nail shooting nose portion 3 and a nail feeding unit 4. The nail shooting nose portion 3 includes a base plate 31 and a face plate 33 sandwiching a safety plate assembly 32 therebetween. The press plate 31 has a through hole 311, whereas the safety plate assembly 32 has an engaging hole 321 in alignment with the through hole 311. The safety plate assembly 32 is slidable relative to the base plate 31 so as to move upward, as shown in FIG. 11, or to move downward as shown in FIG. 12. Since the safety plate assembly 32 is known in the art, the details thereof are not provided herein.

The nail feeding unit 4 according to the present invention includes a nail magazine 40 incorporating a spring unit 5 and a nail pusher 6. The nail magazine 40 is connected to the nail shooting nose portion 3 and includes a magazine base 42 and a magazine cover 43 which cooperatively confine a nail channel 41 (FIG. 9) in communication with the through hole 311 of the base plate 31. The magazine base 42 has a guide groove 421 which extends longitudinally of the magazine base 42, and a guide passage 423 communicated with the nail channel 41 and the guide groove 421. One end of the guide groove 421 is aligned with the through hole 311 of the base plate 31.

The spring unit 5 has a guide tube 51 disposed within the guide passage 421 of the magazine base 42 and receiving a coiled spring 52 therein. One end 511 of the guide tube 51 is fixed to the magazine cover 43. A longitudinal slot 512 is provided axially in a tube wall of the guide tube 51.

The nail pusher plate 6 has two flanges 63 mounted movably on the magazine cover 43 and is slidable along the nail channel 41. A protrusion 62 projects from a back side 61 of the nail pusher plate 6 and extends into the guide groove 421 and the slot 512 through the guide passage 423. The coiled spring 52 is placed in contact with the protrusion 62 so that the nail pusher plate 6 is able to compress the coiled spring 52 when nails are loaded into the nail channel 41 and is urged by the coiled spring 52 to move forward.

Figure 8:
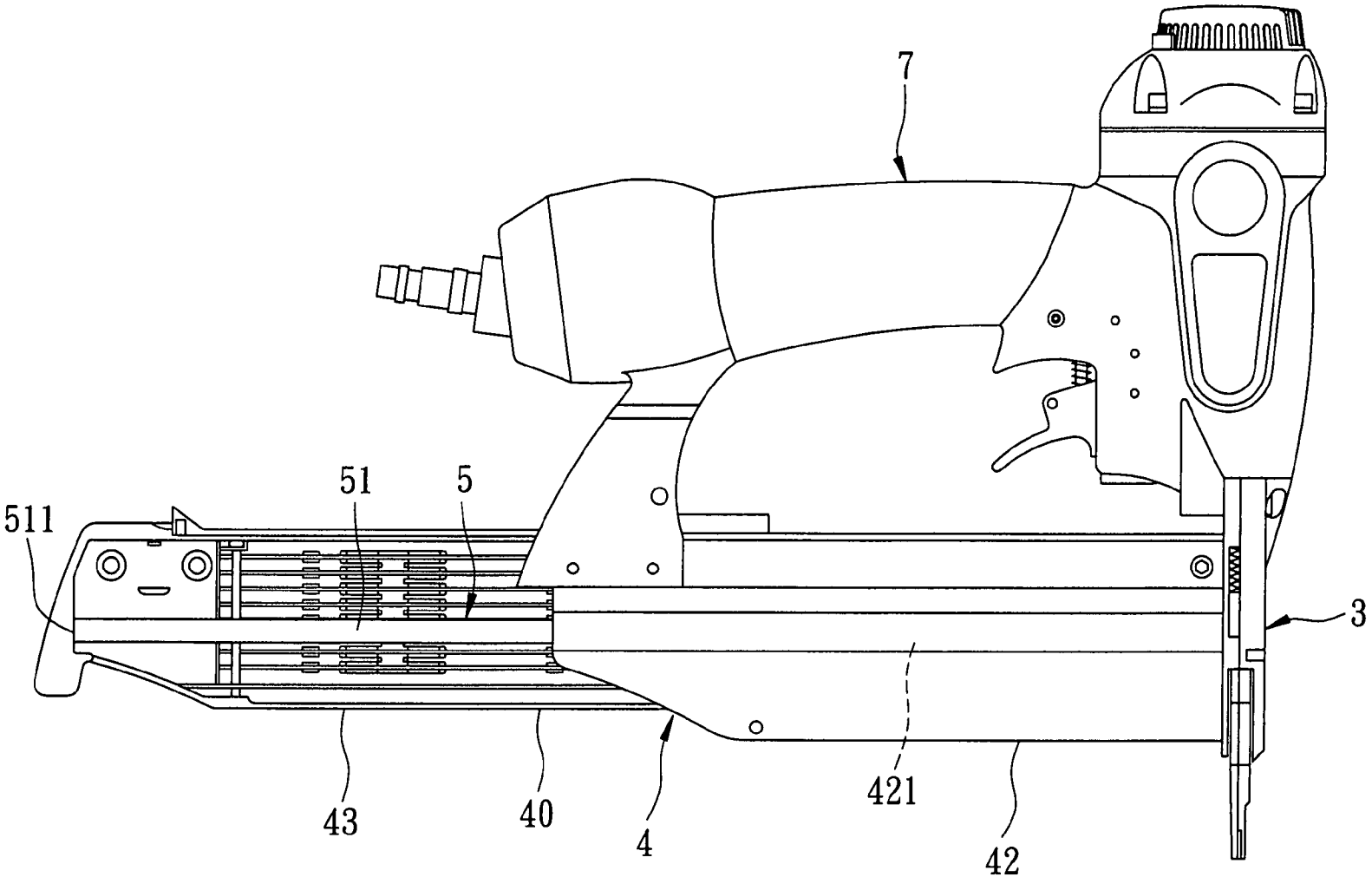
FIG. 8 is a right side view of the nailing gun of FIG. 7.

To supply a nail stick to the nail magazine 4, the magazine cover 43 is slid along the magazine base 42. As the magazine cover 43 is slid, the guide tube 51 and the coiled spring 52 are moved by the magazine cover 43 along the guide groove 421 until they protrude from the guide groove 421 as best shown in FIG. 8. At the same time, the nail pusher plate 6 is moved along the nail channel 41 so that a portion of the nail channel 41 is uncovered as best shown in FIG. 7. At this time, a nail stick 2 can be placed in the nail channel 41 as shown in FIG. 9.

Figure 9:
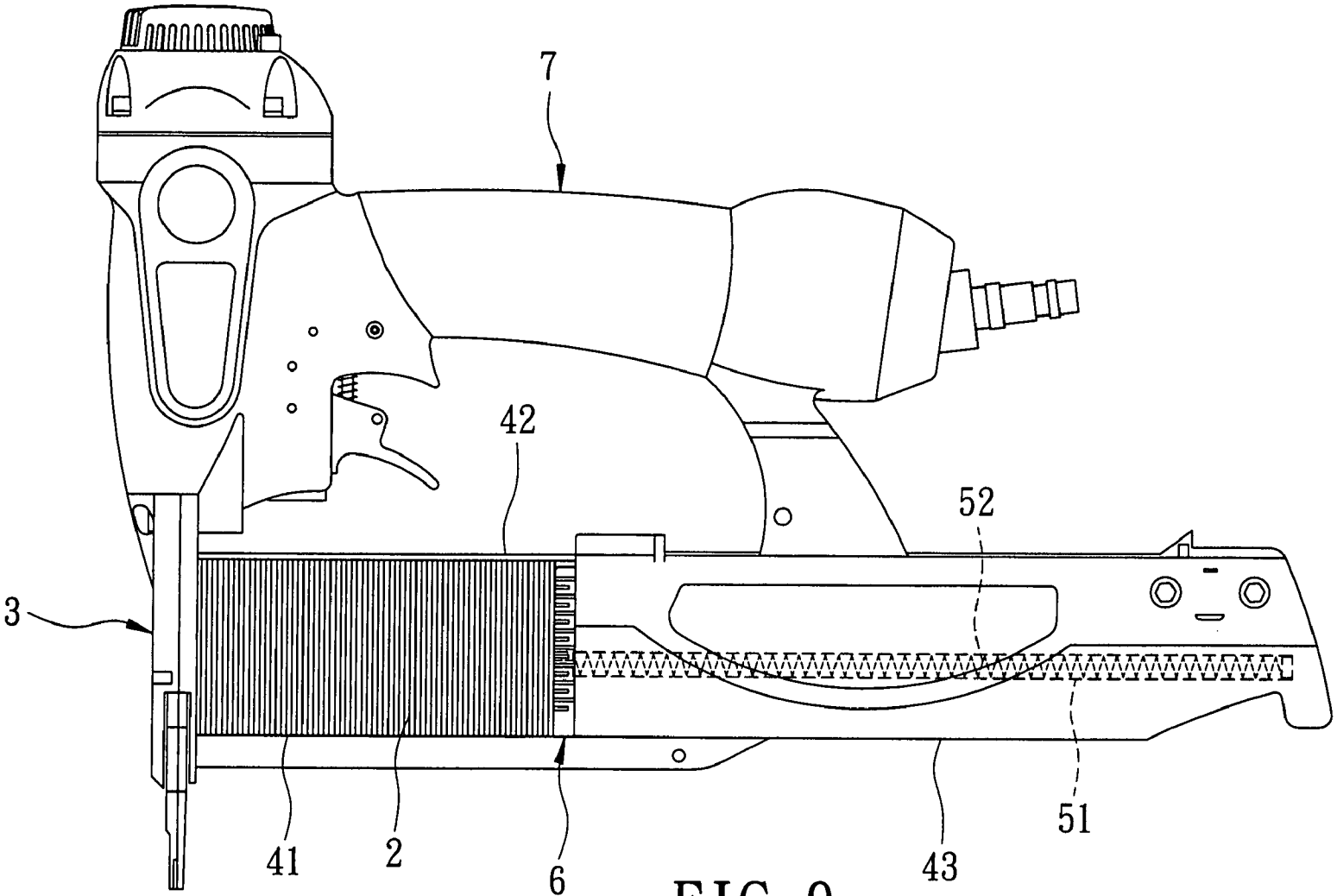
FIG. 9 is the same view as FIG. 7 but with a nail stick loaded on a magazine base of the nailing gun.
Figure 10:
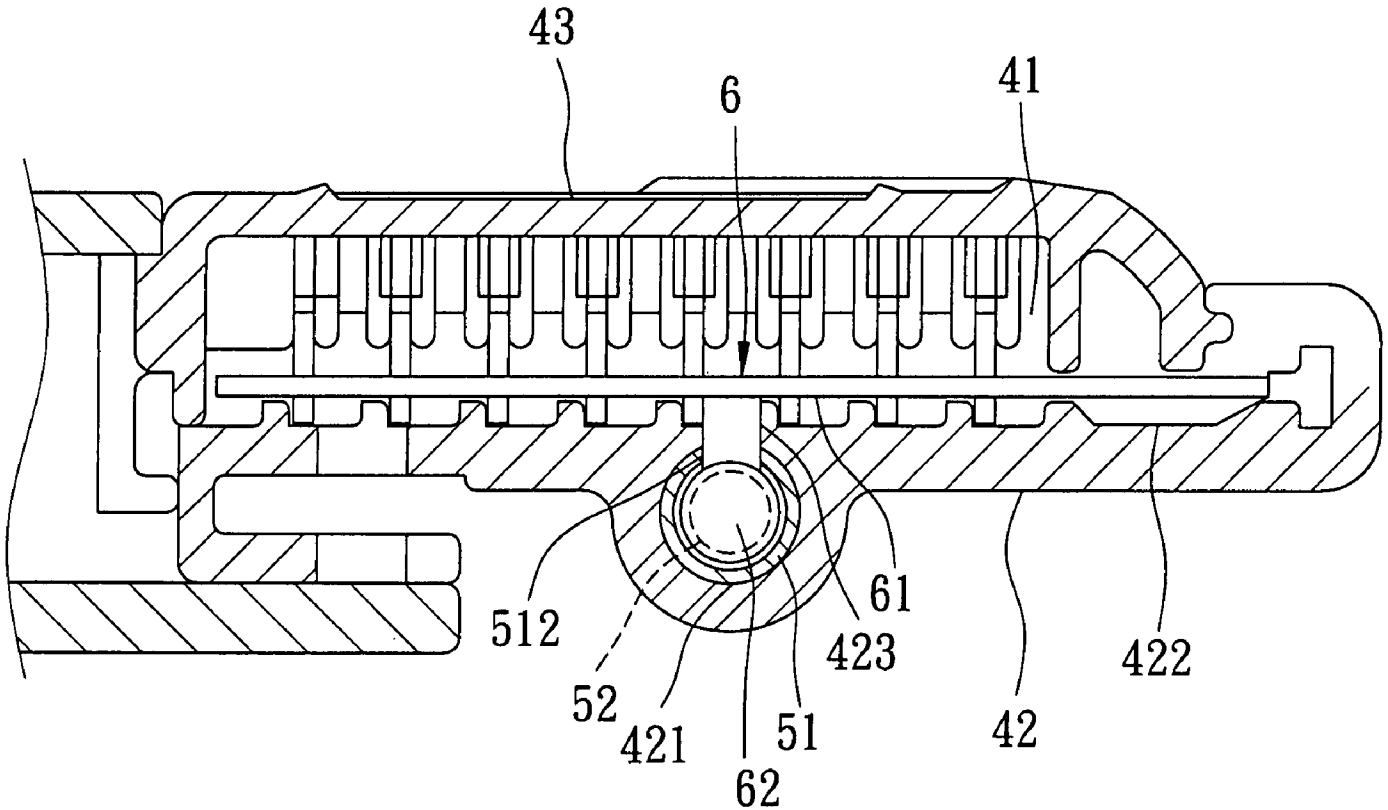
FIG. 10 is a sectional view taken along line 10—10 of FIG. 7.

Referring to FIG. 10 in combination with FIG. 9, after the magazine cover 43 is slid back to close the magazine base 42, the guide tube 51 and the coiled spring 52 retract into the guide groove 421 of the magazine base 42, and the nail stick abuts against the nail pusher plate 6. Due to the protrusion 62 of the nail pusher plate 6 which is in contact with the coiled spring 52, the nail stick is pushed toward the nail shooting nose portion 3 by the coiled spring 52. The nail pusher plate 6 serves to feed one nail from the nail stick into the nail shooting nose portion 3 every time after a nail received by the nail shooting nose portion 3 is driven outward.

Referring to FIG. 11, the safety plate assembly 32 is moved in a direction along an arrow (A) when the nail shooting nose portion 3 is pressed against a site to be nailed for performing a nail shooting operation. Referring to FIG. 12, when no pressure is exerted on the safety plate assembly 32, the safety plate assembly 32 is moved forward in a direction shown by an arrow (B), and the engaging hole 321 of the safety plate assembly 32 is in alignment with the through hole 311 of the base plate 31. In this state, if the nails in the nail magazine 4 are used up, the nail pusher plate 6 is moved to a position close to the base plate 31 of the nail shooting nose portion 3, and the protrusion 62 will project into the engaging hole 321 through the through hole 311 so that the safety plate assembly 32 is limited from movement by the protrusion 62 of the nail pusher plate 6. As such, even when the nail shooting nose portion 3 is pressed against a site to be nailed, the safety plate assembly 32 will not move upward, thereby preventing the nailing gun from operating idly.

As mentioned above, the present invention employs the spring unit 5 which is embedded in the guide groove 421 of the magazine base 42 and which has the coiled spring 52 confined by the guide tube 51. Due to the use of the guide tube 51, the coiled spring 52 can be protected from the intrusion of dust and other contaminating substances. As a result, the performance of the coiled spring 52 can be well maintained, and the nail pusher plate 6 can slide and operate smoothly within the nail magazine 40.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A nailing gun, comprising:

a nail magazine including a magazine base and a magazine cover which are coupled slidably to each other to confine a nail channel, said magazine base having a guide groove which is communicated with said nail channel;

a spring unit including a guide tube received movably in said guide groove, and a coiled spring received movably in said guide tube;

a nail pusher plate slidably received in said nail channel and attached to said magazine cover, said nail pusher plate having a protrusion extending slidably into said guide tube and connected to said coiled spring so that said nail pusher plate is urged by said coiled spring.

2. The nail driving device as claimed in claim 1, wherein said guide tube has a tube wall provided with an axially extending slot, said protrusion extending into said guide tube through said slot.

3. The nail driving device as claimed in claim 1, further comprising a nail shooting nose which includes a base plate, a face plate, and a safety plate assembly disposed movably between said base plate and said face plate, said base plate having a through hole communicated with said nail channel, said safety plate assembly having an engaging hole that can be aligned with said through hole, said protrusion being engageable with said engaging hole by passing through said through hole.

* * * * *